US009324484B2

(12) United States Patent
Ray et al.

(10) Patent No.: US 9,324,484 B2
(45) Date of Patent: Apr. 26, 2016

(54) NANOFERRITE FLAKES

(71) Applicants: Nicole M. Ray, Tempe, AZ (US); William T. Petuskey, Phoenix, AZ (US)

(72) Inventors: Nicole M. Ray, Tempe, AZ (US); William T. Petuskey, Phoenix, AZ (US)

(73) Assignee: Arizona Board of Regents for and on behalf of Arizona State University, Scottsdale, AZ (US)

( * ) Notice: Subject to any disclaimer, the term of this patent is extended or adjusted under 35 U.S.C. 154(b) by 143 days.

(21) Appl. No.: 14/174,803

(22) Filed: Feb. 6, 2014

(65) Prior Publication Data

US 2014/0264145 A1 Sep. 18, 2014

Related U.S. Application Data

(60) Provisional application No. 61/781,462, filed on Mar. 14, 2013.

(51) Int. Cl.

| | |
|---|---|
| ***H01F 10/20*** | (2006.01) |
| ***H01F 1/34*** | (2006.01) |
| ***H01F 41/14*** | (2006.01) |
| ***H01F 1/00*** | (2006.01) |

(52) U.S. Cl.

CPC ..... *H01F 1/0063* (2013.01); *H01F 1/344* (2013.01)

(58) Field of Classification Search

CPC ..... H01F 1/36; H01F 1/37

See application file for complete search history.

(56) References Cited

U.S. PATENT DOCUMENTS

| | | | |
|---|---|---|---|
| 2004/0078960 | A1 | 4/2004 | Roshen |
| 2014/0302344 | A1 | 10/2014 | Petuskey et al. |

FOREIGN PATENT DOCUMENTS

| | | | |
|---|---|---|---|
| JP | 2004039989 | A | 2/2004 |
| JP | 2007149847 | A | 6/2007 |
| KR | 1019910002983 | | 5/1991 |
| KR | 1020110052261 | | 5/2011 |
| WO | WO 2013063467 | A1 | 5/2013 |

OTHER PUBLICATIONS

N. Matsushita, "Spin-sprayed Ni—Zn—Co Ferrite Films with High μr>100 in Extremely Wide Frequency Range 100MHz-1 Ghz," Journal of Applied Physics, vol. 93, No. 10, May 15, 2003, pp. 7133-7135.

Rajesh Kumar Vishwakarma, "Dual-band Stacked Rectangular Microstrip Antenna for Mobile Applications," Antenna Test and Measurement Society, Delhi, India. Feb. 2010. Pt. Ravishankar Shukla University, 2010, 3 pp.

R. Shahbender et al., "Laminate Ferrite Memory," Proceedings of Joint Computer Conference, Nov. 1963, RCA Laboratories. New York ACM New York, 1963. pp. 77-90.

Ailoor K. Subramani et al., "NiZnCo Ferrite Films by Spin Spray Technique: Morphology and Magnetic Properties." 43 J. Mat. Sci. 2372-2376 (2008).

N. Matsushita et al., "Ni—Zn Ferrite Films Synthesized from Aqueous Solution Usable for Sheet-type Conducted Noise Suppressors in GHz Range." 16 J. Electroceram 557-560 (2006).

Masanori Abe, "Ferrite Plating: A Chemical Method Preparing Oxide Magnetic Films at 24-100° C., and its Applications." 45 Electrochimica Acta 3337-3343 (2000).

Daliya S. Mathew et al., "An Overview of the Structure and Magnetism of Spinel Ferrite Nanoparticles and their Synthesis in Microemulsions." 129 Chem. Eng. J. (2007) 51-65.

G. Herzer, "Grain Size Dependence of Coercivity and Permeability in Nanocrystalline Ferromagnets," IEEE Transactions on Magnetics, vol. 26, No. 5, Sep. 1990, pp. 1397-1402.

M. Abe et al., "Phenomenological Theory of Permeability in Films Having no In-plane Magnetic Anisotropy: Application to Spin-sprayed Ferrite Films," 99 Journal of Applied Physics, 08M907, 2006, 4 pp.

Authorized officer Ho Keun Song, International Search Report and Written Opinion for PCT Application No. PCT/US2012/062221, Oct. 26, 2012,14 pp.

Ing Kong et al., "Magnetic and Microwave Absorbing Properties of Magnetite-thermoplastic Natural Rubber Nanocomposites," 322 Journal of Magnetism and Magnetic Materials, 3401-3409 (2010).

Benjamin A. Evans et al., "A Highly Tunable Silicone-based Magnetic Elastomer with Nanoscale Homogeneity," 324 Journal of Magnetism and Magnetic Materials, 501-507 (2012).

Étienne Du Trémolet De Lacheirrerie, Magnetism: Materials and Applications, pp. 192 (New York: Springer Publishing, 2005).

Ali Abou Hassan et al., "Synthesis of iron oxide nanoparticles in a microfluidic device: preliminary results in a coaxial low millichannel," Chem. Commun., Feb. 2008, pp. 1783-1785.

Dangwei Guo et al., "Soft magnetic and high-frequency properties of Ni—Zn ferrite film with FeMn underlayer," Thin Solid Films, vol. 520, Issue 18,2012, pp. 5977-5980.

Dangwei Guo et al., "Structural and magnetic properties of NiZn ferrite films with high saturation magnetization deposited by magnetron sputtering," Applied Surface Science, vol. 256, Issue 8, 2010, pp. 2319-2322.

D. Kingery et al., "Magnetic Properties—19.3 Spinel Ferrite", in Introduction to Ceramics, 1960, New York: John Wiley and Sons, Inc., pp. 991-998.

*Primary Examiner* — Carol M Koslow

(74) *Attorney, Agent, or Firm* — Fish & Richardson P.C.

(57) ABSTRACT

A ferrite layer having a columnar structure is formed, and ferrite flakes are separated from the ferrite layer. The ferrite flakes include a metal oxide having a spinel cubic crystal structure with a stoichiometry represented by $AB_2O_4$, where A and B represent different lattice sites occupied by cationic species, and O represents oxygen in its own sublattice.

20 Claims, 3 Drawing Sheets

NANOFERRITE FLAKES

CROSS-REFERENCE TO RELATED APPLICATION

This application claims priority to U.S. Application Ser. No. 61/781,462 entitled "NANOFERRITE FLAKES" and filed on Mar. 14, 2013, which is incorporated by reference herein in its entirety.

BACKGROUND

"Ferrite" generally refers to metal oxides having a spinel cubic crystal structure with a stoichiometry represented by $AB_2O_4$, where A and B represent different lattice sites occupied by cationic species, and O represents oxygen in its own sublattice. Thin film ferrites have been formed by methods including embedding bulk ferrite into MYLAR shims and doctor blading bulk ferrite into sheets and then firing at high temperature. Ferrites have also been deposited on plastic and glass substrates to form thin films by methods including, for example, spin-spray plating, chemical solution deposition (CSD), chemical vapor deposition (CVD), plasma enhanced CVD (PECVD), physical vapor deposition (PVD), and sputtering. Certain deposition techniques, such as pulsed laser deposition and sputtering, can involve heating substrates to high temperatures (e.g., over 600° C.) to crystallize ferrite films. Thin film ferrites exhibit a wide array of properties, including high complex permeabilities, relatively high resistivity, low losses, and high resonance frequencies. In some cases, ferrite thin films are weak in saturation magnetization and high in coercivity compared to bulk ferrites.

SUMMARY

In one aspect, a ferrite layer having a columnar polycrystalline structure is formed, whereby ferrite flakes are separated from the substrate which may be any rigid flexible material that can withstand the depositions conditions. The ferrite flakes have a spinel cubic crystal structure with a stoichiometry represented by $AB_2O_4$, where A and B represent different lattice sites occupied by cationic species, and O represents oxygen in its own sublattice.

Implementations may include one or more of the following features.

Forming the ferrite layer may include spin-spraying the ferrite layer onto a substrate. In some cases, the substrate is selected from the group consisting of thermoplastic, glass, and metal. In certain cases, the substrate is a thermoplastic, and the ferrite layer is formed at a temperature less than the glass transition temperature of the thermoplastic. The ferrite flakes form during the deposition process as films that are limited in lateral size, or may form by fracturing and spalling from the initial deposit. The flakes may be annealed at a temperature less than the glass transition temperature of the thermoplastic.

The ferrite layer may be formed at a temperature between 50° C. and 100° C. In some cases, the ferrite layer is formed at a rate between 5 nm/min and 500 nm/min. Rotation of the substrate during spin-spraying is typically between 50 and 500 rpm. The ferrite flakes may be nanocrystalline or polycrystalline with grain sizes in a range between 20 nm and 100 nm in diameter. The ferrite flakes may include nickel, zinc, cobalt and iron as crystalline oxides. The ferrite flakes may be annealed, for example, by heating the ferrite flakes at a ramp rate of 50° C./min or less.

The ferrite layer, or flakes, that are produced by this method are polycrystalline in nature. In some cases, the individual grains are less than 100 microns in any one dimension. Typically, the size of the individual grains are on the order of 15 to 100 nm in at least one dimension, from which a flake or film will comprise many in a dense or nearly dense microstructure. Often, the grains appear to be columnar, or they could be equiaxed, in shape. It is implied that the occasional use of the term "nanoferrite" means that the ferrite microstructure includes crystalline grains that are sub-micron in size. In some cases, for example, the crystalline grains are less than 100 nanometers in any one dimension.

In some implementations, the ferrite flakes are combined with a liquid precursor material, and the liquid precursor material is solidified to embed the ferrite flakes. The liquid precursor material may be selected from the group consisting of polymers, elastomers, and epoxies. The ferrite flakes may be oriented in the liquid precursor material before solidifying the liquid precursor material. Orienting the ferrite flakes in the material may include, for example, centrifugating the material after combining the ferrite flakes with the liquid precursor material and before solidifying the liquid precursor material. In some cases, an additive is combined with the ferrite flakes and the liquid precursor material before solidifying the liquid precursor material. The additive may be selected from the group consisting of a drug, a contrast agent, and magnetic or nonmagnetic filler materials. The application of an external magnetic field may also be a way of enhancing the degree of orientation of the flakes as the matrix material polymerizes or otherwise solidifies around them.

Embedded ferrite flakes formed as described herein may be included in a device such as an electromagnetic noise suppression device, a semiconductor device, a magnetic sensor, an antenna, a global positioning system, a radar absorbing structure, a synthetic aperture radio, and a medical imaging device.

As described herein, loose ferrite flakes are formed at a rapid deposition rate.

The details of one or more implementations are set forth in the accompanying drawings and the description below. Other features and advantages will be apparent from the description and drawings, and from the claims.

DETAILED DESCRIPTION

Figure 1A:
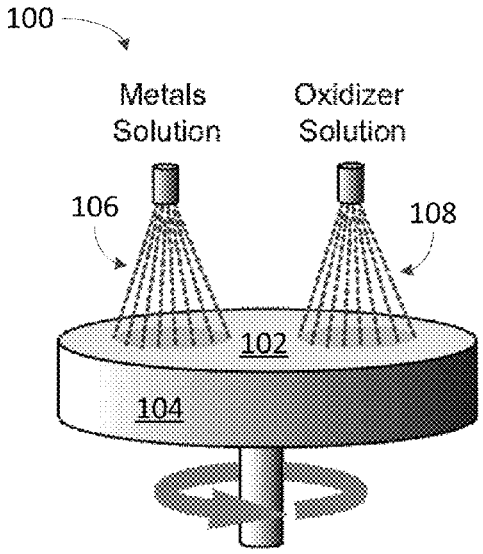
FIG. 1A shows an apparatus for forming a ferrite layer on a substrate.

As described herein, nanoferrite flakes can be obtained from a ferrite layer deposited on a substrate to form thin film ferrite. The substrate may include thermoplastic, glass, or metal. Examples of suitable thermoplastics include polyetheretherketone (PEEK), polyether imide, nylon, polyetherketoneketone, and the like. Deposition may include, for example, spin-spray plating a ferrite on the surface of a substrate. FIG. 1A depicts an apparatus 100 for spin-spray plating a ferrite on the surface of a substrate 102. During deposition of the ferrite, the substrate may be heated on a rotating platform 104. A metals solution 106 (reactant) and an oxidizer solution 108 (oxidant) are provided to the substrate 102 on the rotating platform 104. As described, for example, in Abe et al., Jpn. J. Appl. Phys. 22 (1983) pp. L511-L513, and Itoh et al., Jpn. J. Appl. Phys. 27 (1988) pp. 839-842, both of which are incorporated by reference herein, the metals solution 106 is an aqueous solution including two or more salts, such as chlorides of iron, nickel, zinc, cobalt, copper, manganese, indium, or other metal with a valence of two; the oxidizer solution 108 can be, for example, an aqueous solution of sodium nitrite, glacial acetic acid, and ammonium hydroxide.

Figure 1B:
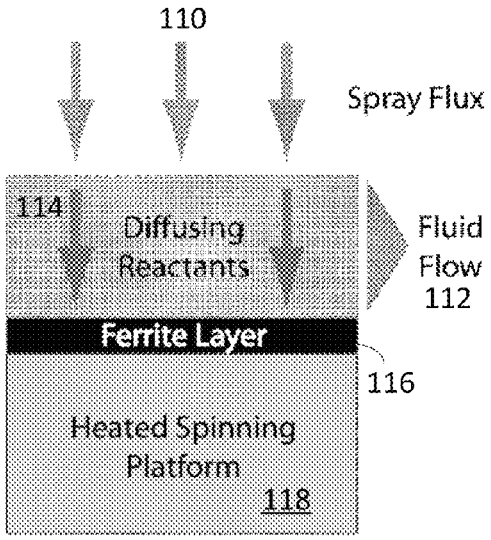
FIG. 1B illustrates the coating process that occurs using the apparatus shown in FIG. 1A.

Providing the reactant and oxidant can include atomizing liquid droplets (e.g., with a nebulizer), thereby promoting a more uniform temperature on the substrate. The rotation rate, pH, fluid flow, and temperature may be adjusted to achieve a desired spinel nanostructure. In an example, a thermoplastic substrate is mounted on an 8" disc rotating at 60 rpm. The platform on which the substrate is positioned is heated to a temperature up to 100° C., up to 200° C., or up to 300° C. (e.g., 90° C.). The flow rate of the reactant and the oxidant can be automated at a selected rate (e.g., 55 mL/min). The rotation rate and platen temperature may be monitored. FIG. 1B depicts the spray flux 110, fluid flow 112, diffusing reactants 114, ferrite layer 116, and heated spinning platform 118 in an exemplary experimental setup.

The deposition rate of the ferrite is influenced by factors including reactant concentration (metal concentration), gas pressure, and fluid flow rate of the spray, and may range from 5 to 500 nanometers/min (e.g. 300 to 400 nanometers/min). Ferrite layers formed as described herein are nanostructured, and typically include polycrystalline nanoparticles deposited in a textured columnar network, with dimensional features of between 20 nm and 1000 nm in diameter and between 0.3 μm and 12 μm in height. Reactants and deposition conditions can be selected such that the textured columnar network is flakey. In contrast, other reactants and deposition conditions yield continuous and coherent films that are relatively dense, smooth, uniform, and well-bonded to the substrate. See, for example, Subramani et al., Materials Science and Engineering: B 148(1-3) pp. 136-140 and Kondo et al., U.S. Pat. No. 7,648,774, both of which are incorporated herein by reference. In some cases, a flakey columnar network is formed for a spin rate between 50 and 500 rpm (e.g., between 90 and 350 rpm). After a nanoferrite thin film is formed, nanoferrite flakes can be separated easily from the substrate and further processed. In one example, the nanoferrite flakes are annealed (e.g., at a temperature between 300° C. and 1100° C.). Annealing the flakes typically increases the permeability and decreases the resonance frequency of the flakes.

The nanoferrite flakes are combined with a material (e.g., a polymer, elastomer, or epoxy), and the material is solidified/polymerized to yield a structure with embedded nanoferrite flakes. In some cases, the nanoferrite flakes are oriented within the structure (e.g., with centrifugation) to achieve desired electromagnetic properties, such as permeability, resonance frequency, and low core losses. The material can be solidified in a desired shape or solidified and then cut or otherwise shaped into selected dimensions. In certain cases, one or more additives (e.g., drug, contrast agent, nonmagnetic fillers, etc.) may be combined with the nanoferrite flakes and the material before solidifying the material.

Figure 2A:
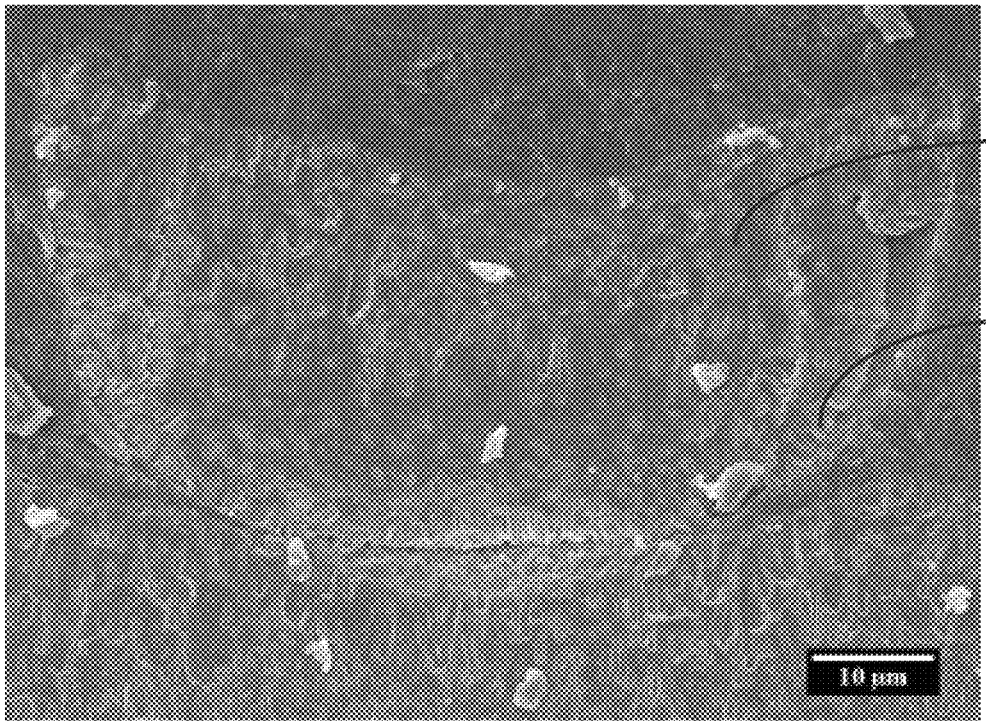
FIG. 2A is a scanning electron microscopy (SEM) image of a $Ni_{0.23}Zn_{0.33}Co_{0.05}Fe_{2.40}$ ferrite layer showing columnar and bulk spinel ferrite morphology.
Figure 2B:
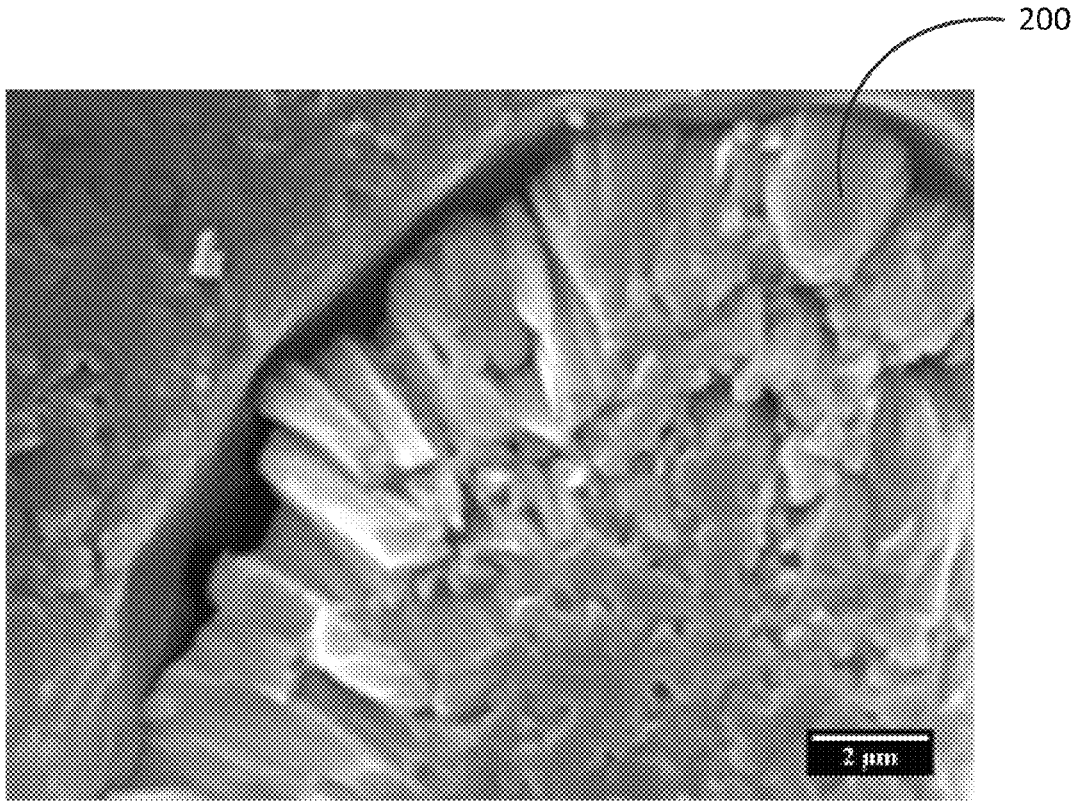
FIG. 2B is an enlarged view of the $Ni_{0.23}Zn_{0.33}Co_{0.05}Fe_{2.40}$ ferrite columns seen in FIG. 2A.

In one example, $(Ni—Zn—Co)_x Fe_3\text{-}xO_4$ was spin spray plated onto VICTREX APTIV PEEK substrate to a thickness of 12 μm at 90° C. at a deposition rate of 375 μm/min. After the ferrite was deposited and cleaned with deionized water, it was cooled to room temperature. Next the $Ni_{0.23}Zn_{0.33}Co_{0.05}Fe_{2.40}$ thin film ferrite layer was pulled off the substrate. The flakes were collected and placed into a vial. The nanoferrite flakes were mounted in a low viscosity, "ultra thin" epoxy resin and centrifuged to preferentially orient the flakes in roughly a parallel configuration. A sample was cut from the dried epoxy, and the electromagnetic properties of the sample were measured. FIG. 2A is an SEM image of a sample cut from the dried epoxy showing columnar 200 and bulk 202 spinel ferrite morphology. FIG. 2B is an enlarged view of $Ni_{0.23}Zn_{0.33}Co_{0.05}Fe_{2.40}$ ferrite columns 200 shown in FIG. 2A.

Figure 3:
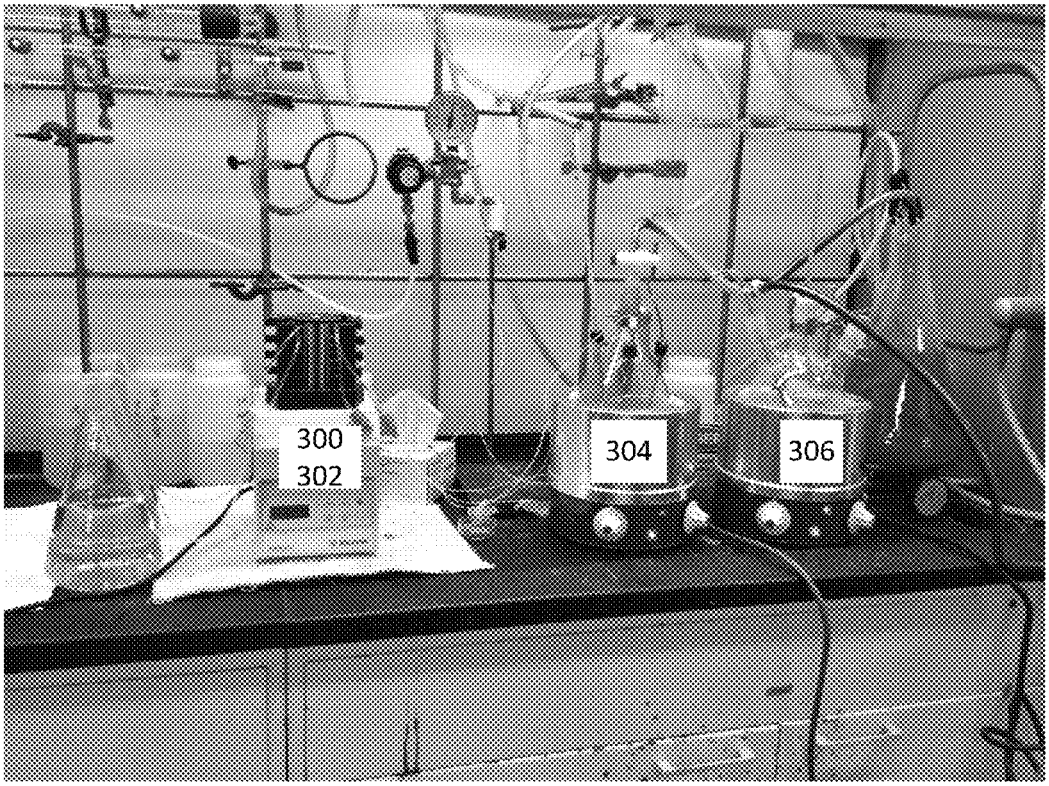
FIG. 3 is an experimental set-up for direct formation of nanoferrite flakes.
Figure 4:
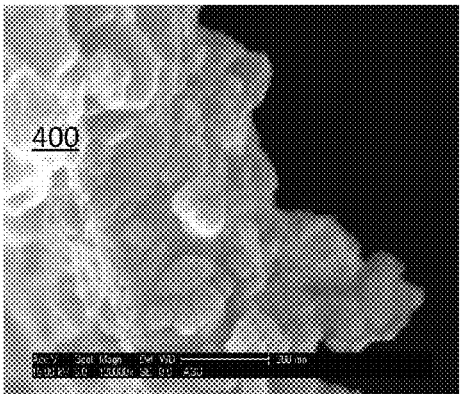
FIG. 4 is an SEM image of nanoferrite flakes formed in the apparatus shown in FIG. 3.

In another example, nanoferrite flakes were formed directly as a powder rather than as a flaky layer. The experimental set-up is shown in FIG. 3. In the process, a metal chloride solution and an oxidant solution were sprayed separately by nebulizers 300 and 302 into a pressurized glass vessel 304 with a magnetic stir bar and heated to 90° C. While the nebulizers 300 and 302 were spraying, powder was removed from the glass vessel 304 via application of a vacuum and collected in situ in glass vessel 306. The magnetic powder was later separated using neodymium magnets and a centrifuge, then washed at least 3 times and dried in a drying furnace set to 70-100° C. FIG. 4 is an SEM image of the resulting nanoferrite flakes 400. This procedure simplified the process, while maintaining the permeability, resonance frequency, and low core losses.

Advantages of the low temperature processes described herein (e.g., below 100° C.) include the use of plastic substrates, including plastic substrates unsuitable for high temperature processes, to form thin film ferrites in a range of sizes. Depending on the raw material composition and processing conditions, embedded nanoferrite flakes formed as described herein exhibit a wide array of properties, including high complex permeabilities (e.g., in the MHz and GHz range), relatively high resistivity, low losses, and high resonance frequencies. Applications for embedded nanoferrite flakes include sensing and actuation applications, miniaturized low-microwave inductors, antennas (e.g., wireless and mobile applications, as well as dual- and tri-band antennas in global positioning systems (GPS), radar absorbing structure (RAS), synthetic aperture radar (SAR)), high-density perpendicular recording layers, semiconductor devices, noise suppression, filters, dielectric materials, composites, and magnetic sensors. Embedded nanoferrite flakes may also be used in a variety of medical applications, including medical imaging devices, contrasting agents, and drug delivery, Advantages of ferrites formed as described herein include light weight, low volume, low cost, and large-scale production, as well as flexible design, low sensitivity to manufacturing tolerances, and easy installation.

A number of embodiments have been described. Nevertheless, it will be understood that various modifications may be made without departing from the spirit and scope of the disclosure. Accordingly, other embodiments are within the scope of the following claims.

What is claimed is:

1. A method comprising:

forming a ferrite layer having a columnar structure; and separating ferrite flakes from the ferrite layer, wherein forming the ferrite layer comprises spin-spraying the ferrite layer on a substrate, and wherein the ferrite flakes comprise a metal oxide having a spinel cubic crystal structure with a stoichiometry represented by $AB_2O_4$, where A and B represent different lattice sites occupied by cationic species, and O represents oxygen in its own sublattice.

2. The method of claim 1, further comprising annealing the ferrite flakes.

3. The method of claim 2, wherein annealing the ferrite flakes comprises heating the ferrite flakes at a ramp rate of 50° C. per minute or less.

4. The method of claim 1, wherein the substrate is selected from the group consisting of thermoplastic, glass, and metal.

5. The method of claim 4, wherein the substrate is a thermoplastic, and the ferrite layer is formed at a temperature less than the glass transition temperature of the thermoplastic.

6. The method of claim 4, wherein the substrate is a thermoplastic, and the ferrite flakes are annealed at a temperature less than the glass transition temperature of the thermoplastic.

7. The method of claim 1, wherein the ferrite layer is formed at a temperature between 50° C. and 100° C.

8. The method of claim 1, wherein the ferrite layer is formed at a rate between 5nm/min and 500 nm/min.

9. The method of claim 1, wherein rotation of the substrate during spin-spraying is between 50 and 500 rpm.

10. The method of claim 1, wherein the ferrite flakes are nanocrystalline or polycrystalline with grain sizes in a range between 20 nm and 100 nm in diameter.

11. The method of claim 1, wherein the ferrite flakes comprise nickel, zinc, cobalt and iron as crystalline oxides.

12. The method of claim 1, further comprising:

combining ferrite flakes with a liquid precursor material; and solidifying the liquid precursor material to embed the ferrite flakes in a solidified material, thereby yielding embedded ferrite flakes.

13. The method of claim 12, wherein the liquid precursor material is selected from the group consisting of polymers, elastomers, and epoxies.

14. The method of claim 12, further comprising orienting the ferrite flakes in the liquid precursor material before solidifying the liquid precursor material.

15. The method of claim 14, wherein orienting the ferrite flakes in the material comprises centrifugating the material after combining the ferrite flakes with the liquid precursor material and before solidifying the liquid precursor material.

16. The method of claim 12, further comprising combining an additive with the ferrite flakes and the liquid precursor material before solidifying the liquid precursor material.

17. The method of claim 16 wherein the additive is selected from the group consisting of a drug, a contrast agent, and magnetic or nonmagnetic filler materials.

18. Embedded ferrite flakes formed by the method of claim 12.

19. A device comprising the embedded ferrite flakes of claim 18.

20. The device of claim 19, wherein the device is selected from the group consisting of an electromagnetic noise suppression device, a semiconductor device, a magnetic sensor, an antenna, a global positioning system, a radar absorbing structure, a synthetic aperture radio, and a medical imaging device.

* * * * *